US007810260B2

(12) United States Patent
Pope et al.

(10) Patent No.: US 7,810,260 B2
(45) Date of Patent: Oct. 12, 2010

(54) CONTROL SYSTEM FOR TOOL COUPLING

(75) Inventors: Richard M. Pope, Tipp City, OH (US); Anand Arumugam, Columbus, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 0 days.

(21) Appl. No.: 11/962,203

(22) Filed: Dec. 21, 2007

(65) Prior Publication Data

US 2009/0158625 A1 Jun. 25, 2009

(51) Int. Cl.
*E02F 5/02* (2006.01)
*G05D 1/02* (2006.01)

(52) U.S. Cl. ..... 37/468; 37/414; 37/408; 414/699; 414/723; 701/50

(58) Field of Classification Search ..... 37/403, 37/468, 408–410, 414; 414/423, 697, 699, 414/700, 705, 723; 701/50; 172/2–4.5
See application file for complete search history.

(56) References Cited

U.S. PATENT DOCUMENTS 3,786,871 A * 1/1974 Long et al. ..... 172/4.5
3,920,137 A * 11/1975 McCain ..... 414/697
4,017,114 A * 4/1977 LaBounty ..... 294/88
4,542,929 A * 9/1985 Possinger ..... 294/88
4,779,364 A * 10/1988 Holmdal ..... 414/723
4,888,890 A * 12/1989 Studebaker et al. ..... 37/348
4,926,948 A * 5/1990 Davidson et al. ..... 172/4.5
4,958,981 A * 9/1990 Uchihashi ..... 414/694
4,989,652 A 2/1991 Hansson
5,078,215 A * 1/1992 Nau ..... 172/4.5
5,107,932 A * 4/1992 Zachman et al. ..... 172/4.5
5,242,258 A 9/1993 Weyer
5,327,812 A 7/1994 Weyer et al.
5,438,771 A * 8/1995 Sahm et al. ..... 37/348
5,442,868 A * 8/1995 Ahn ..... 37/348

(Continued)

FOREIGN PATENT DOCUMENTS

DE 20116666 U1 2/2003

(Continued)

OTHER PUBLICATIONS

"Swedes go full tilt for success" Construction Weekly, vol. 4, No. 24, Jun. 17, 1992, p. 19.

(Continued)

*Primary Examiner*—Thomas A Beach
(74) *Attorney, Agent, or Firm*—Dinsmore & Shohl LLP

(57) ABSTRACT

A control system for a tool coupling of the type that attaches a tool to an excavator dipper stick and provides for rotation of the tool with respect to the dipper stick about an axis, and further provides for tilting of the tool, includes a rotation sensor and a tilt sensor. The rotation sensor is mounted on the coupling for determining the amount of rotation of the tool with respect to the dipper stick about an axis. The tilt sensor is mounted on the coupling for determining the amount of tilt of the tool with respect to gravity. A control is responsive to the rotation sensor and to the tilt sensor for determining the orientation of the tool.

18 Claims, 10 Drawing Sheets

U.S. PATENT DOCUMENTS

| | | | | |
|---|---|---|---|---|
| 5,487,230 | A | 1/1996 | Weyer et al. | |
| 5,584,346 | A * | 12/1996 | Sakamoto et al. | 172/4.5 |
| 5,752,333 | A * | 5/1998 | Nakagawa et al. | 37/348 |
| 5,782,018 | A * | 7/1998 | Tozawa et al. | 37/348 |
| 5,848,485 | A | 12/1998 | Anderson et al. | |
| 6,024,145 | A * | 2/2000 | Ackles | 144/382 |
| 6,112,145 | A * | 8/2000 | Zachman | 701/50 |
| 6,126,216 | A * | 10/2000 | Tollefson | 294/2 |
| 6,169,948 | B1 * | 1/2001 | Fujishima et al. | 701/50 |
| 6,263,595 | B1 * | 7/2001 | Ake | 37/348 |
| 6,325,590 | B1 | 12/2001 | Cain et al. | |
| 6,330,503 | B1 * | 12/2001 | Sharp et al. | 701/50 |
| 6,435,235 | B1 | 8/2002 | Hicks | |
| 6,447,240 | B1 | 9/2002 | Cain et al. | |
| 6,609,315 | B1 * | 8/2003 | Hendron et al. | 37/348 |
| 6,691,437 | B1 | 2/2004 | Yost et al. | |
| 6,732,458 | B2 * | 5/2004 | Kurenuma et al. | 37/348 |
| 6,823,616 | B1 * | 11/2004 | Gutter et al. | 37/461 |
| 6,826,465 | B2 * | 11/2004 | Ishimoto et al. | 701/50 |
| 6,951,067 | B1 * | 10/2005 | Dietz et al. | 37/348 |
| 7,093,383 | B2 * | 8/2006 | Mennen et al. | 37/348 |
| 7,152,519 | B2 * | 12/2006 | Dubreuil | 92/106 |
| 2003/0103804 | A1 | 6/2003 | Bjuhr | |
| 2005/0105240 | A1 | 5/2005 | Jonsson | |
| 2006/0096137 | A1 * | 5/2006 | Hendron et al. | 37/348 |
| 2006/0230645 | A1 * | 10/2006 | McCain | 37/348 |
| 2008/0000111 | A1 * | 1/2008 | Green | 37/348 |
| 2008/0047170 | A1 * | 2/2008 | Nichols | 37/348 |
| 2008/0213075 | A1 * | 9/2008 | Sjogren et al. | 414/700 |

FOREIGN PATENT DOCUMENTS

| | | | |
|---|---|---|---|
| WO | 2006065154 | A1 | 6/2006 |

OTHER PUBLICATIONS

Invitation to Pay Additional Fees and Partial International Search for International application No. PCT/US2008/087161 dated Mar. 4, 2009.

* cited by examiner

CONTROL SYSTEM FOR TOOL COUPLING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a control system for a tool coupling and, more particularly, to such a control system for use on an excavator carrying an excavator bucket for determining the orientation and position of the bucket teeth. The control system may display orientation and position information to assist an operator in manually controlling the movement of the excavator bucket, or it may use this information to effect automatic control of the movement of the bucket in a desired manner.

Excavators have gained wide use for handling rocks, dirt, logs, tree stumps and the like at job sites, as well as for performing a variety of excavation tasks, including those that require fairly precise movement of an excavator bucket. Other tasks to which an excavator can be applied are best performed with a different tool carried by the excavator, such as for example a grappling device. An excavator typically has a dipper stick which is attached at one end to a boom that extends from the excavator frame. The other end of the dipper stick may be attached to the tool, such as for example a grappling device or an excavator bucket, by means of a connector configured for the task. Such a connector, as shown in U.S. Pat. No. 4,958,981, issued Sep. 25, 1990, to Uchihashi can provide a way of rotating the tool at the end of the dipper stick under hydraulic control as desired so that the tool can be moved precisely into desired orientations under the control of the excavator operator. The connector of the Uchihashi patent only permits the rotation of the tool about a single axis. More advanced connectors have been developed and marketed by companies, such as Indexator AB, of Vindeln, Sweden under the mark Rototilt. The Rototilt connector includes one or two additional hydraulic cylinders which are connected to the rotatable portion of the connector and which permit the rotatable portion of the connector to be tilted from side to side. Since the connector and the tool may be pivoted about a third axis by the linkage arrangement at the end of the dipper stick, the tool can be maneuvered into almost any desired position and orientation without actually moving the excavator frame to a new location. Not only does this expand significantly the tasks that can be performed using the excavator, but it also facilitates changing the specific tools carried by the excavator.

With the added flexibility of such an arrangement for controlling movement of a tool, however, comes the complexity that results from the additional hydraulic cylinders and mechanisms that must be controlled simultaneously. A need exists for an arrangement for monitoring the position and orientation of a tool, such as an excavator bucket, when manipulated by a machine, such as an excavator, so that the control of the tool can be facilitated.

SUMMARY OF THE INVENTION

This need is met by an excavator and control system according to the present invention. The excavator includes an excavator frame, a boom extending from the excavator frame, and a dipper stick pivotally attached to the boom and extending therefrom. The excavator further includes a tool, such as for example, a bucket having bucket teeth. Other tools having other working portions may also be used. A coupling attaches the bucket to the excavator dipper stick. The coupling provides for rotation of the tool with respect to the dipper stick about a rotation axis. The coupling also provides for tilting of the bucket about a tilt axis that is generally perpendicular to the rotation axis. A positioning system on the excavator determines the location of the coupling. A rotation sensor on the coupling determines the amount of rotation of the bucket about the rotation axis with respect to the dipper stick. A tilt sensor on the coupling determines the amount of tilt of the bucket with respect to gravity. A control, responsive to the rotation sensor and to the tilt sensor, and to the positioning system on the excavator, determines the position and the orientation of the teeth of the bucket. The control may display the position and orientation of the teeth to the excavator operator to facilitate operator control. The control may also provide automatic control of the movement of the teeth of the bucket or semi-automatic control of the teeth of the bucket.

The tilt sensor may determine the tilt of the bucket with respect to a gravity reference in two orthogonal axes. The control may provide an output indicating the rotation of the bucket with respect to the dipper stick and the tilting of the bucket with respect to a gravity reference. The output of the control may be provided to a display for viewing by the operator of the excavator.

The invention may further comprise a control system for a tool coupling of the type intended to attach a tool to an excavator dipper stick. The tool coupling provides for rotation of the tool about an axis with respect to the dipper stick, and further provides for tilting of the tool. The control system includes a rotation sensor, a tilt sensor and a control that is responsive to the rotation sensor and to the tilt sensor for determining the orientation of the tool. The rotation sensor is positioned on the coupling for determining the amount of rotation of the tool with respect to the dipper stick about the axis. The tilt sensor is positioned on the coupling for determining the amount of tilt of the tool with respect to gravity.

The tilt sensor may determine the amount of tilt of the tool about two orthogonal axes with respect to gravity. The control may provide an output indicating the rotation of the tool with respect to the dipper stick and the tilting of the tool with respect to a gravity reference. The tool may be an excavator bucket having teeth. The control in such a case provides an output indicating the rotation of the bucket with respect to the dipper stick and the tilting of the teeth of the bucket with respect to gravity. The output of the control may be provided to a display to assist an operator in controlling the position of the excavator bucket. Further, the output of the control may be provided to a position control system for controlling the orientation and position of the bucket to effect excavation automatically in a desired manner.

Accordingly, it is an object to provide for the orientation and control of a tool by an excavator, or the like, by monitoring the rotation and tilt of the tool with appropriate sensors on a coupling that attaches the tool to the dipper stick of the excavator.

DETAILED DESCRIPTION OF THE PREFERRED EMBODIMENT

Figure 1:
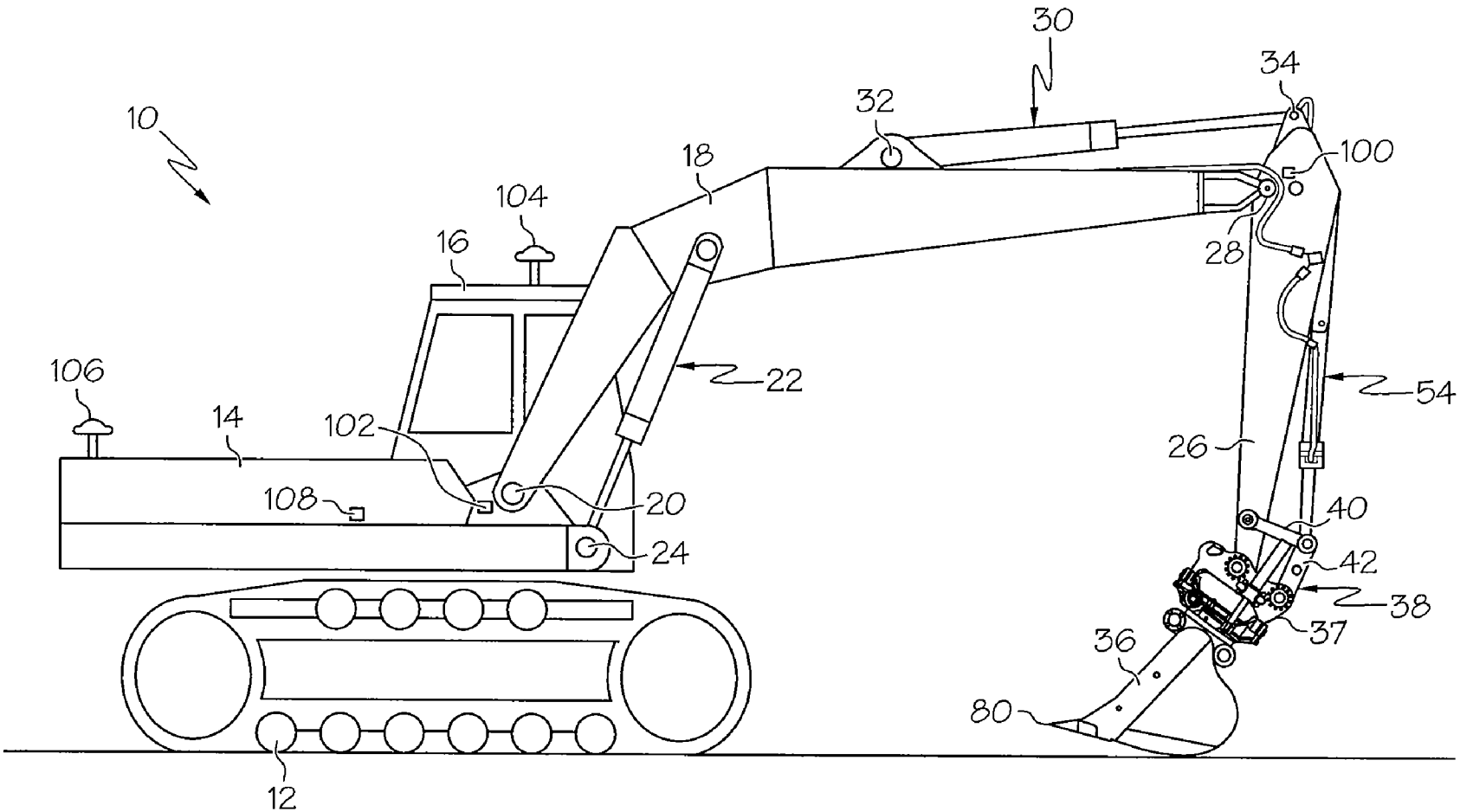
FIG. 1 is a drawing diagrammatically representing a typical excavator of the type with which the present invention may be used.
Figure 2:
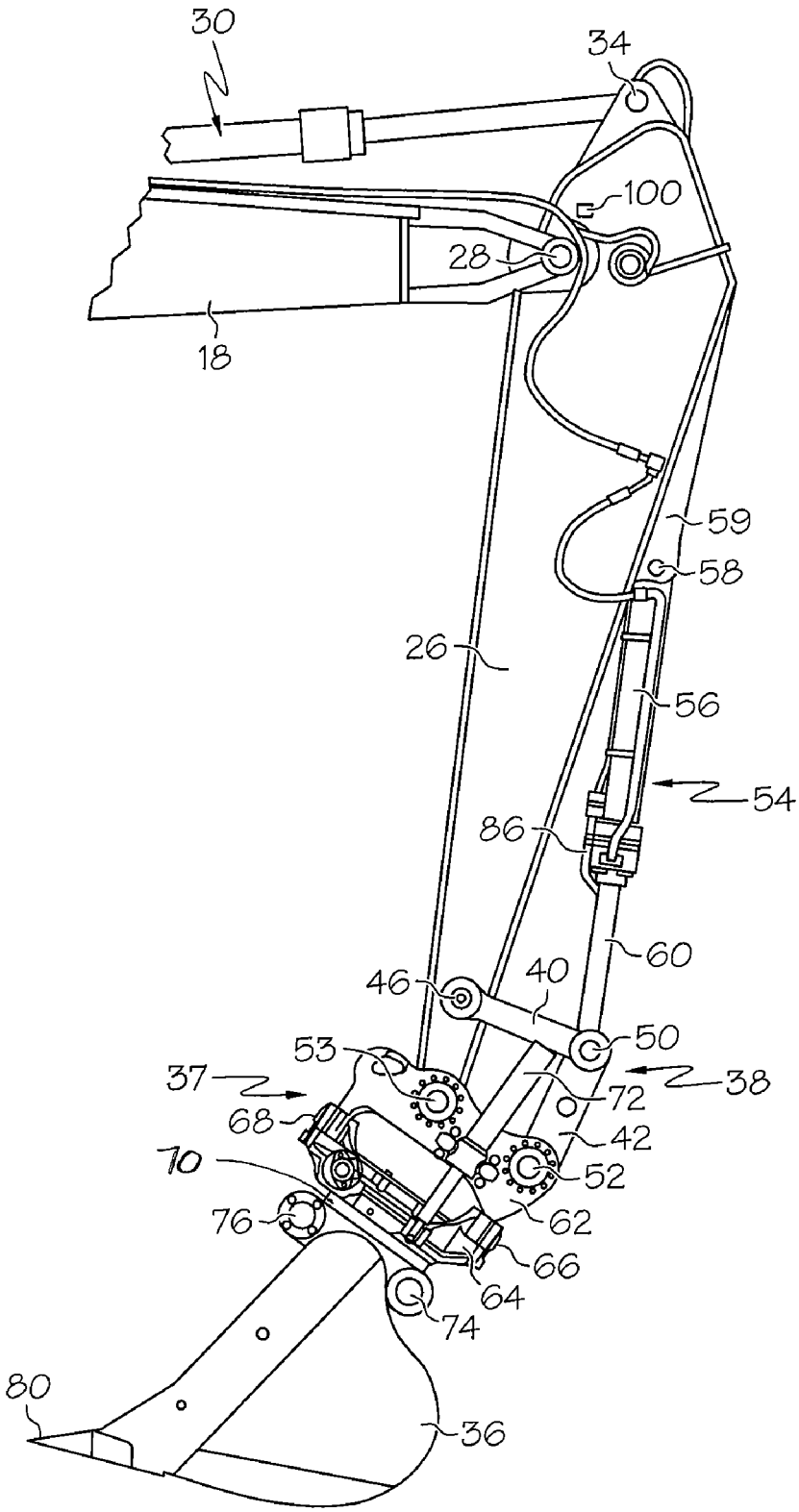
FIG. 2 is an enlarged view of the dipper stick and bucket of the excavator, and the coupling that attaches the dipper stick and the bucket, with a portion of the boom broken away.

Reference is made to FIGS. 1 and 2 which illustrate a typical excavator 10 of the type with which the present invention may be used. Excavator 10 includes ground engaging tracks 12, and a frame 14 which carries an operator cab 16. A boom 18 is pivotally attached to frame 14 at 20. Boom 18 is also pivotally attached to hydraulic actuator 22, which is secured to frame 14 at 24 in such a manner that extending the actuator 22 causes boom 18 to be raised, and retracting the actuator 22 causes boom 18 to be lowered. In similar fashion, dipper stick 26 is pivotally attached to the end of boom 18 at 28. Hydraulic actuator 30 is pivotally attached to boom 18 at 32, and to dipper stick 26 at 34, such that extending actuator 30 causes dipper stick to be rotated in a clockwise direction as seen in FIG. 1, and retracting actuator 30 causes dipper stick to be rotated in a counterclockwise direction as seen in FIG. 1.

Excavator bucket 36 is mounted on a coupling 37 which is attached to a bucket linkage 38 that is pivotally secured to the end of the dipper stick 26. Bucket linkage 38 includes a pair of parallel links 40 (only one of which is visible in FIGS. 1 and 2), and a pair of parallel links 42 (only one of which is visible in FIGS. 1 and 2). The coupling 37 attaches bucket 36 to the dipper stick 26 and the links 42 at 52 and 53. Link 40 and coupling 37 are pivotally attached to dipper stick 26 at 46 and 53, respectively, and to the coupling 42 at 50 and 52, respectively.

The excavator 10 further includes a hydraulic actuator 54 having a hydraulic cylinder 56 pivotally connected to the dipper stick 26 at 58 between a pair of ridges 59. The hydraulic actuator 54 has a piston rod 60 that is pivotally connected to the bucket linkage 38 at 50. Extension or contraction of the hydraulic actuator 54 causes the coupling 37 and the excavator bucket 36 to be pivoted by the bucket linkage 38 with respect to the dipper stick 26 and about an axis that is general perpendicular to the plane of the drawings in FIGS. 1 and 2.

The coupling 37 may any commercially available coupling, such as for example the Rototilt® RT 60B coupling sold by Indexator AB, of Vindeln, Sweden. The coupling has an upper attachment element 62 which is attached at points 52 and 53 to link 42 and dipper stick 26, respectively, a swivel element 64 which is mounted to swivel about a pair of bearings 66 and 68, and a rotor element 70 that is mounted to the swivel element 64 for rotation about a rotation axis that is generally perpendicular to the swivel axis. A pair of hydraulic cylinders 72 (only one of which is shown in FIG. 2) control tilting of the swivel element 64. The rotor element 70 is driven by a hydraulic motor (not shown). The bucket 36 is attached to the swivel element 64 at 74 and 76 and rotates and swivels with the movement of the coupling 37.

Figure 3:
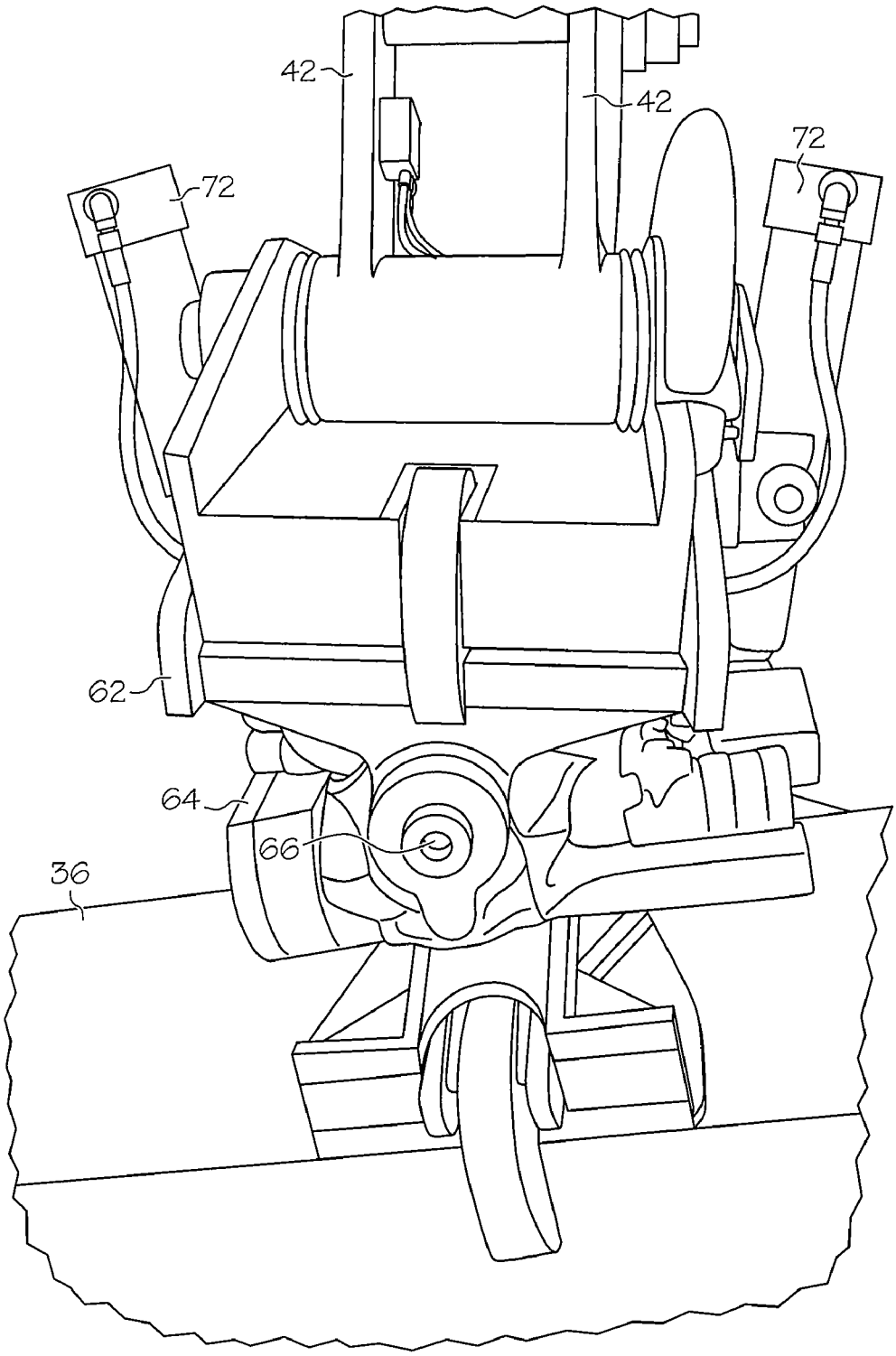
FIG. 3 is an enlarged view of a portion of the dipper stick, the bucket, and the coupling, illustrating tipping of the bucket laterally.

The coupling 37 permits the bucket 36 to be moved in two additional degrees of freedom, thus permitting the bucket 36 to achieve positions that are needed or useful in performing excavation without the requirement that the excavator be repositioned at the work site. For example, the teeth 80 of the bucket 36 will generally be oriented in a position that is perpendicular to the boom 18 and the dipper stick 26 in an excavator that does not include a coupling 37. Coupling 37 permits the bucket to be rotated so that the teeth are generally parallel to the dipper stick 26 and to the boom 18, or at an angle to the dipper stick 26 and the boom 18. Additionally, coupling 37 permits the bucket 36 to be swiveled about an axis that extends through bearings 62 and 68. Swiveling of the bucket 36 is shown in FIGS. 3 and 5. Rotation of the bucket about a rotation axis is indicated generally in FIG. 4 by arrow 80.

It will be appreciated that the additional degrees of freedom that result from the use of the coupling also require that the excavator operator control additional cylinders and motors, increasing the difficulty of operating the excavator, and increasing the difficulty of making full and efficient use of the various motions made available by the coupling 37.

Figure 6:
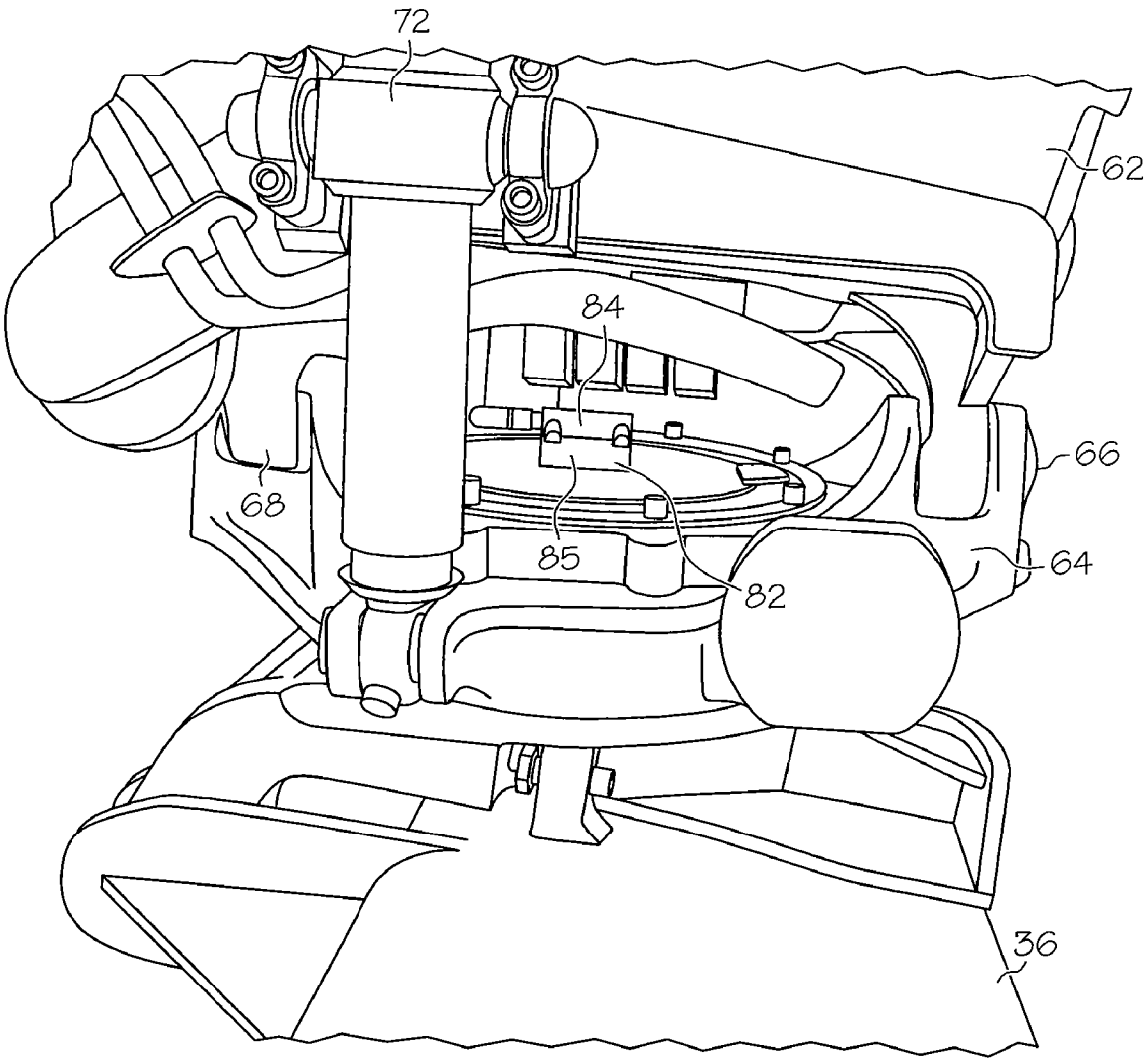
FIG. 6 is a side view of the coupling showing the tilt sensor on the coupling.

The present invention provides a control system for a tool coupling of the type intended to attach a tool to an excavator dipper stick. As explained above, the coupling provides for rotation of the tool about an axis with respect to the dipper stick, and further provides for tilting the tool. As seen in FIG. 6, the control system includes a rotation sensor 82 on the coupling 37 for determining the amount of rotation of the tool, in this instance the bucket 36, with respect to the dipper stick 26 about the rotation axis. The sensor 82 is housed within the cover 84, and may comprise any conventional rotation sensor. A tilt sensor 85 within the swivel element 64 rotates with the rotor element 70 and the tool 36. The tilt sensor 85 on the coupling 37 determines the amount of tilt of the tool 36 with respect to gravity. The control system further includes a control 86, shown in FIG. 7, that is responsive to the rotation sensor 82 and to the tilt sensor 85, for determining the orientation of the bucket 36.

The tilt sensor 85, also within cover 84 may preferably be an inclinometer of the type that determines the amount of tilt of the tool or bucket 36 with respect to gravity about two orthogonal axes. The control 86 provides an output 88 indicating the rotation of the bucket 36 with respect to the dipper stick 26 and the tilting of the bucket 36 with respect to a gravity reference. As was previously noted, the excavator bucket 36 includes a row of teeth 80 along its lower edge to facilitate digging. The output 88 of the control 86 may be supplied to a display 90, preferably located in the excavator cab 16. When the operator in the cab 16 views this display, it is easier for him to control the movement of the bucket 36 through manual operation of the excavator hydraulic controls.

It will be appreciated that the output of the control 86 will provide an indication of the inclination and rotation of the bucket teeth. To this information may be added the position of the end of the dipper stick 26 at the point where the coupling 37 is mounted, such that the position of the bucket 36 may also be displayed. The position of the end of the dipper stick 26 may be determined in any of a number of ways. For example, the relative angular orientation between the dipper stick 26, and the coupling 37 may be monitored by monitoring the movement of extensible hydraulic actuator 54 which includes cylinder 56 and piston rod 60. Once the extension of the actuator 54 is measured, it is a straightforward calculation, based on the geometry of the dipper stick 26, coupling 37, and actuator 54, to determine the relative positions of the bucket 36 and the coupling 37. A cable extension linear position transducer (not shown) may be used to monitor the extension of the cylinder 54, as disclosed in U.S. Pat. No. 6,325,590, issued Dec. 4, 2001, to Cain et al. The disclosure of the '590 is incorporated herein by reference.

The position of the dipper stick 26 may be determined based upon any of several known measurement approaches. As seen in FIG. 1, angle encoder 100 may provide the angular orientation between the dipper stick 26 and the boom 18. Angle encoder 102 provides the angular orientation between the boom 18 and the frame of the excavator 14. GPS antennae 104 and 106 may provide the position and orientation of the excavator frame. Finally, a two axis inclinometer 108 on the excavator frame determines any tilting of the frame. Once the position and orientation of the excavator frame is determined, it is a simple trigonometric calculation to determine the position and orientation of the end of the dipper stick. Once the position and orientation of the end of the dipper stick 26 is determined, then the orientation and position of the bucket teeth 80 may be determined.

It will be appreciated that other techniques may be used to determine the position and orientation of the dipper stick. For example, the vertical position of the dipper stick may be determined with the use of a laser receiver which receives a rotating reference beam of laser light. The inclination of the dipper stick may be determined in such an arrangement by an inclinometer carried on the dipper stick. Still other systems may be based in part upon the use of a robotic total station which is located at a known position and which tracks the movement of the excavator or an element of the excavator with respect to that known position.

Figure 7:
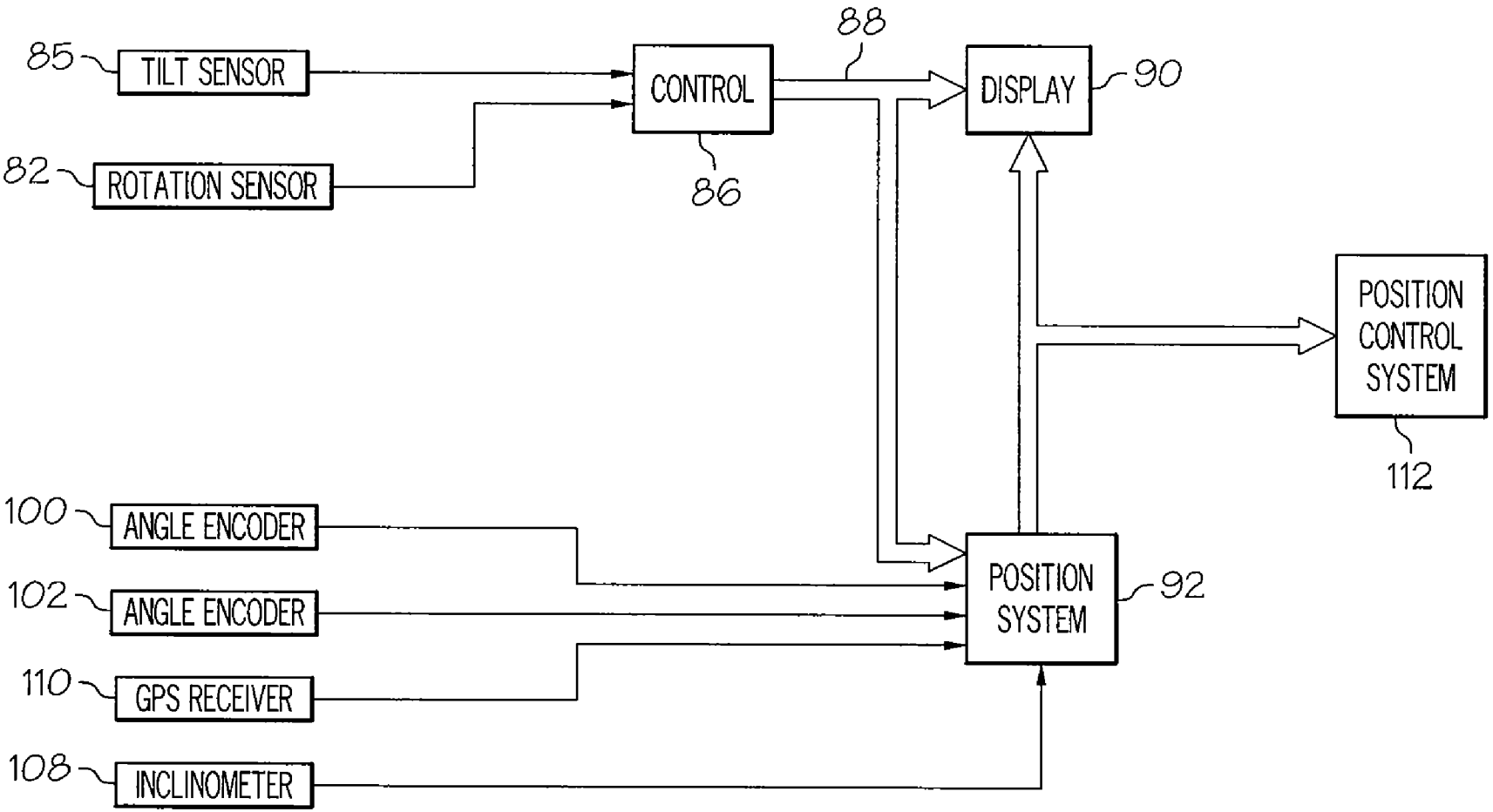
FIG. 7 is a schematic representation of circuitry associated with the present invention.

As shown in FIG. 7, the output 88 of the control 86 is provided to position system 92 which is also responsive to angle encoders 100, and 102, a GPS 110 receiver connected to GPS antennae 104 and 106, and inclinometer 108. The output of the position system 92 may be supplied to display 90 to assist the excavator operator. If desired, some aspect of the operation of the excavator, for example the digging depth may also be automatically controlled. The output of the position system 92 may be compared with the desired position of the bucket teeth by a position control system 112 and the difference used to control or limit motion of the bucket 36.

Figure 8:
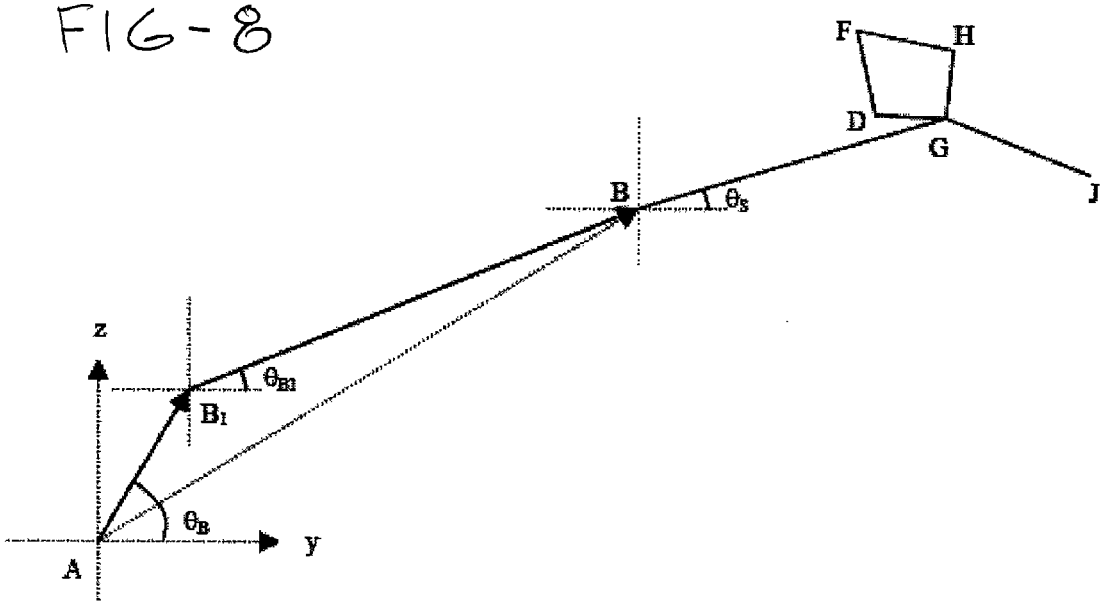
FIGS. 8 through 11 are diagrammatic representatives useful in explaining the manner in which the position and orientation of the bucket teeth may be determined.

Reference is made to FIGS. 8 through 11 which are diagrammatic representations useful in explaining the manner in which the position and orientation of the bucket teeth can be determined. FIG. 8 illustrates the geometry of the excavator. The line $AB_1$ represents part of the boom, with the line $B_1B$ representing an articulated boom. Line BG represents the dipper stick. If the machine does not have an articulated boom, then line AB represents the boom. A is the boom pivot, B is the stick pivot, G is the bucket pivot, J is the bucket teeth and $B_1$ represents the VA boom pivot. The lengths $AB_1$, $B_1B$, AB, BG, DG, DF, GH and GJ can be physically measured on an actual machine.

Figure 9:
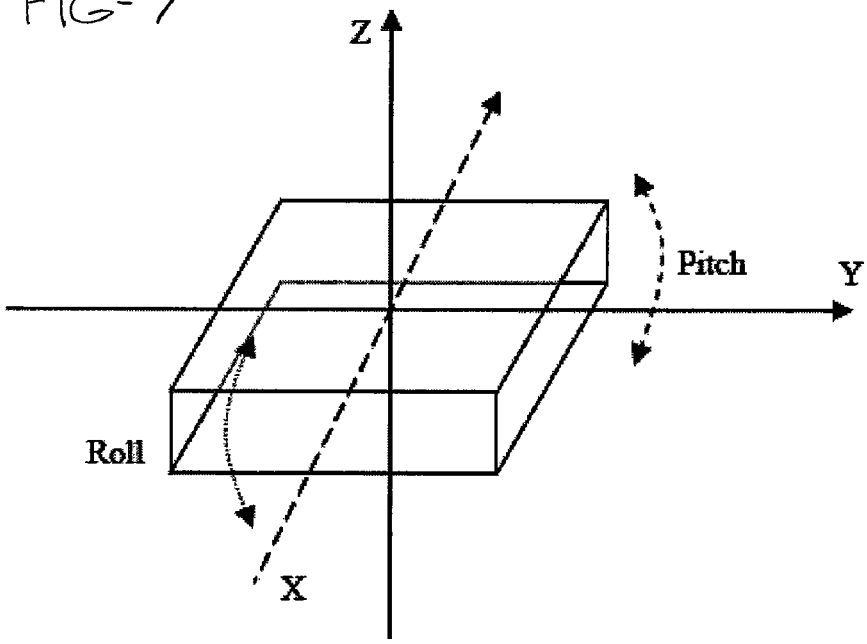
Figure 10:
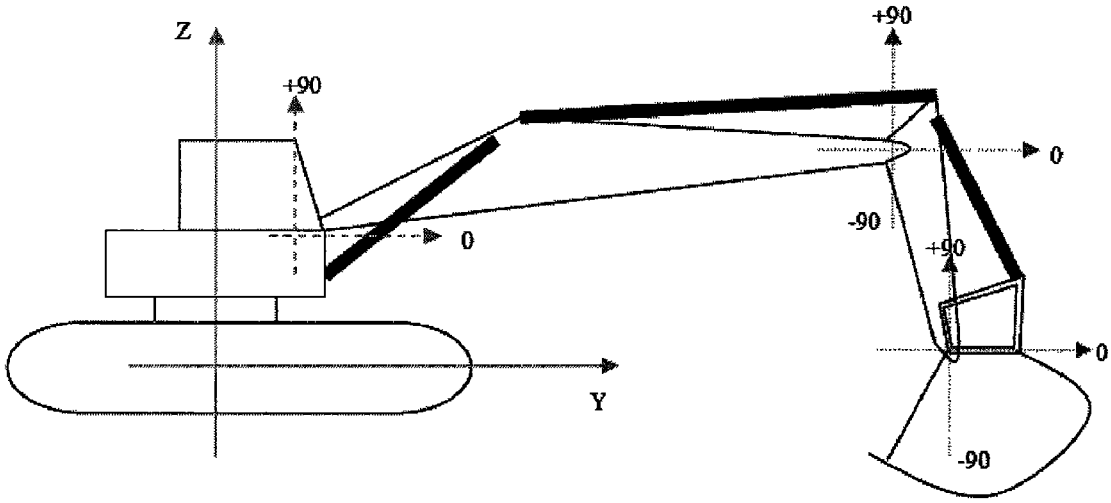
Figure 11:
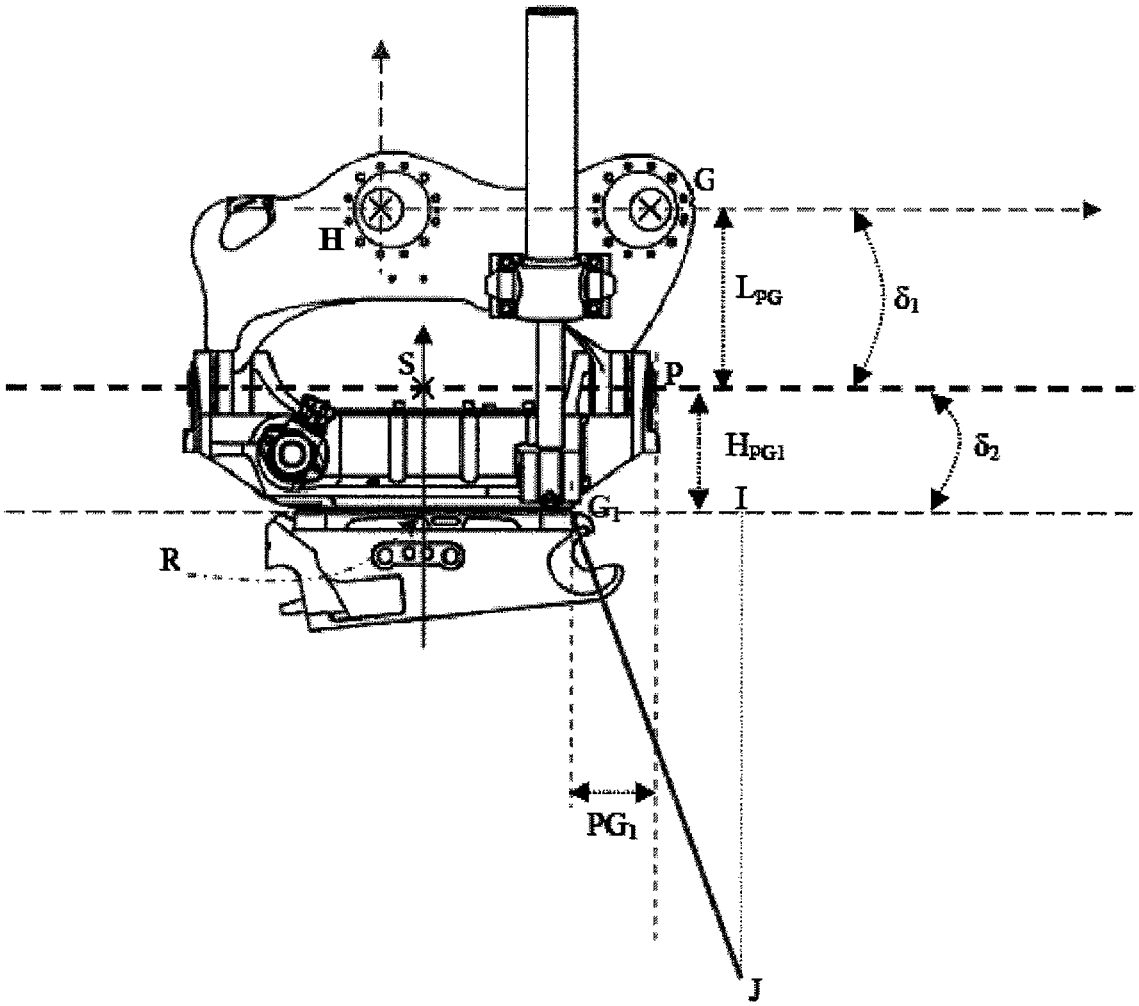

FIGS. 9 and 10 illustrate the angle and directional conventions adopted for this analysis XY plane is the plane of the platform (or car body) with y-axis being the direction of reach, x-axis is the direction of the lateral displacement and z-axis is the direction of elevation. FIG. 9 depicts the reference frame orientation and FIG. 10 depicts the reference frame for the angles. For the angles, 0 degree is always in the direction outward from the machine and the direction of increase of the angle is counter clockwise i.e. the angle becomes more positive if the boom, stick and bucket link are lifted upwards and the angle becomes more negative if the components are lowered.

The sensor that detects the angle of the boom is mounted on the boom ($AB_1$ or AB). Similarly for the stick, the sensor is mounted anywhere along the line BG. For the bucket, a pitch and roll sensor will be mounted close to the center of rotation of the bucket, R (refer to FIG. 11). The pitch axis is aligned with the line parallel to $RG_1$ and the roll axis is aligned parallel to the width of the bucket. To determine the rotation of the bucket, a rotation sensor will be mounted at R, as well.

Positioning the bucket teeth, J, can be done in three stages:

1. Position G with respect to the center of rotation of the excavator 1.
2. Position J with respect to S.
3. Position S with respect to G.

Using the results from the above steps, the position of J with respect to the center rotation of the machine can be determined.

Lengths $L_{G^1J}$, $L_{G^1I}$ & $L_{RG^1}$ are measured using a measuring tape. From the measurements angle $RG_1J$ can be computed. Therefore $$\text{Angle } RG_1J = \theta_{G_1J} = \pi - \cos^{-1}\left(\frac{L_{IG_1}}{L_{G_1J}}\right) \quad [1]$$

If the points R and $G_1$ are leveled then the position of J is given by:

$$(J_x, J_y, J_z) = \{0, (L_{RG^1} + L_{IG^1}), -L_{G^1J}\cos\theta_{G^1J}\} \quad [2]$$

Let δ2 be the angle between the line passing through R & $G_1$ and the tilting axis of the bucket. Both S and R lie on the axis of rotation of the bucket. The point S is the point of intersection between the bucket's tilting axis and rotation axis. The vertical distance S-R is given by:

$$SR = H_{PG^1} \quad [3]$$

The angle δ2 can be measured by following a two stage process:

1. Level the top of the coupling where the bucket is attached i.e. level the line $RG_1$.
2. Level the tilting axis of the bucket, i.e. the line PS.

The difference in the pitch of the bucket in positions 1 and 2 gives the angle δ2.

With respect to S, position of J (refer [2]) is given by:

$$(J_x, J_y, J_z) = \{0, (L_{RG^1} + L_{IG^1}), -(H_{PG^1} + L_{G^1J}\cos\theta_{G^1J})\} \quad [4]$$

Rotate the vector $\overrightarrow{SJ}$ about S by $\delta_2$ to align it with the tilting axis PS along the yz-plane. Position of J after rotating by $\delta_2$ is given by:

$$(J_x, J_y, J_z) = \{0, (J_y\cos\delta_2 - J_z\sin\delta_2), (J_y\sin\delta_2 + J_z\cos\delta_2)\} \quad [5]$$

Since the pitch and roll sensor is mounted near R, we know the pitch of the bucket ($\theta_{BP}$) and the roll of the bucket ($\theta_{BR}$). The rotation of the bucket about the axis RS (ϕ) is given by the rotation sensor mounted at R.

Let $(J'_x, J'_y, J'_z)$ be the position of the bucket teeth after pitch the bucket by $\theta_{BP}$. Using [5] we get the position of J' with respect to S as:

$$J'_x = {}_x = 0$$

$$J'_y = J_y\cos\theta_{BP} - J_z\sin\theta_{BP}$$

$$J'_z = J_y\sin\theta_{BP} + J_z\cos\theta_{BP} \quad [6]$$

Let $(J''_x, J''_y, J''_z)$ be the position of the bucket teeth after tilting the bucket by $\theta_{BR}$ about the line PS. Using [6] we get the position of J" with respect to S as:

$$J''_x = -J'_z \sin\theta_{BR}$$

$$J''_y = J'_y$$

$$J''_z = J'_z \sin\theta_{BR} \quad [7]$$

Let $(J'''_x, J'''_y, J'''_z)$ be the position of the bucket teeth after rotating the bucket by 'ϕ' about the line RS. Using [7] we get the position of J''' with respect to S as:

$$J'''_x = J''_x \cos\phi + J''_y \sin\phi$$

$$J'''_y = J''_y \cos\phi - J''_x \sin\phi$$

$$J'''_z = J''_z \quad [8]$$

Positioning S with respect to G:

With respect to S the point P is given by:

$$(P_x, P_y, P_z) = \{0, (L_{RG}1 + L_{PG}1), 0\} \quad [9]$$

Therefore the position of S with respect to P is given by:

$$(S_x, S_y, S_z) = \{0, -(L_{RG}1 + L_{PG}1), 0\} \quad [10]$$

Figure 4:
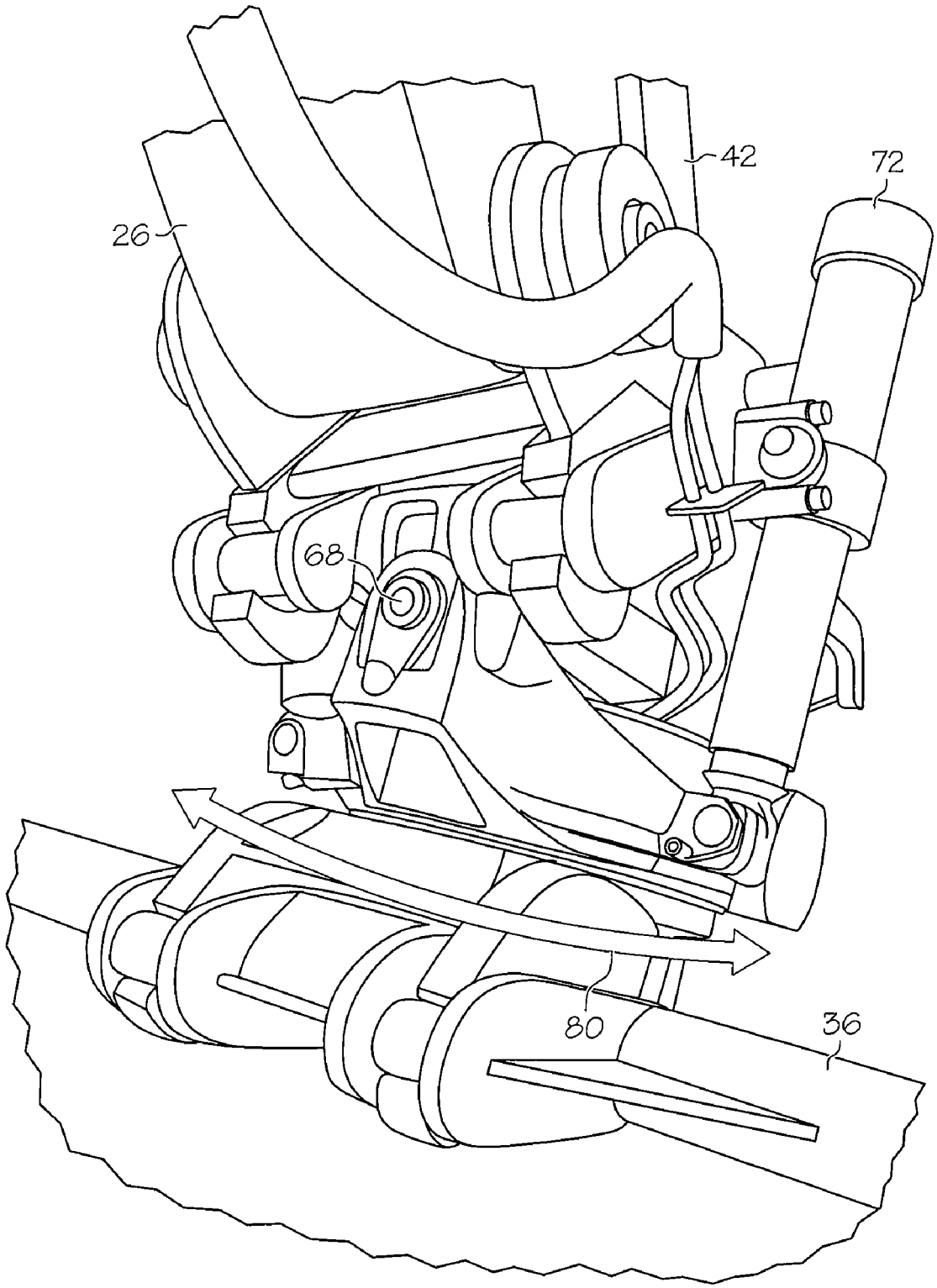
FIG. 4 is a further enlarged view, similar to FIG. 3, but taken from the other side of the dipper stick.
Figure 5:
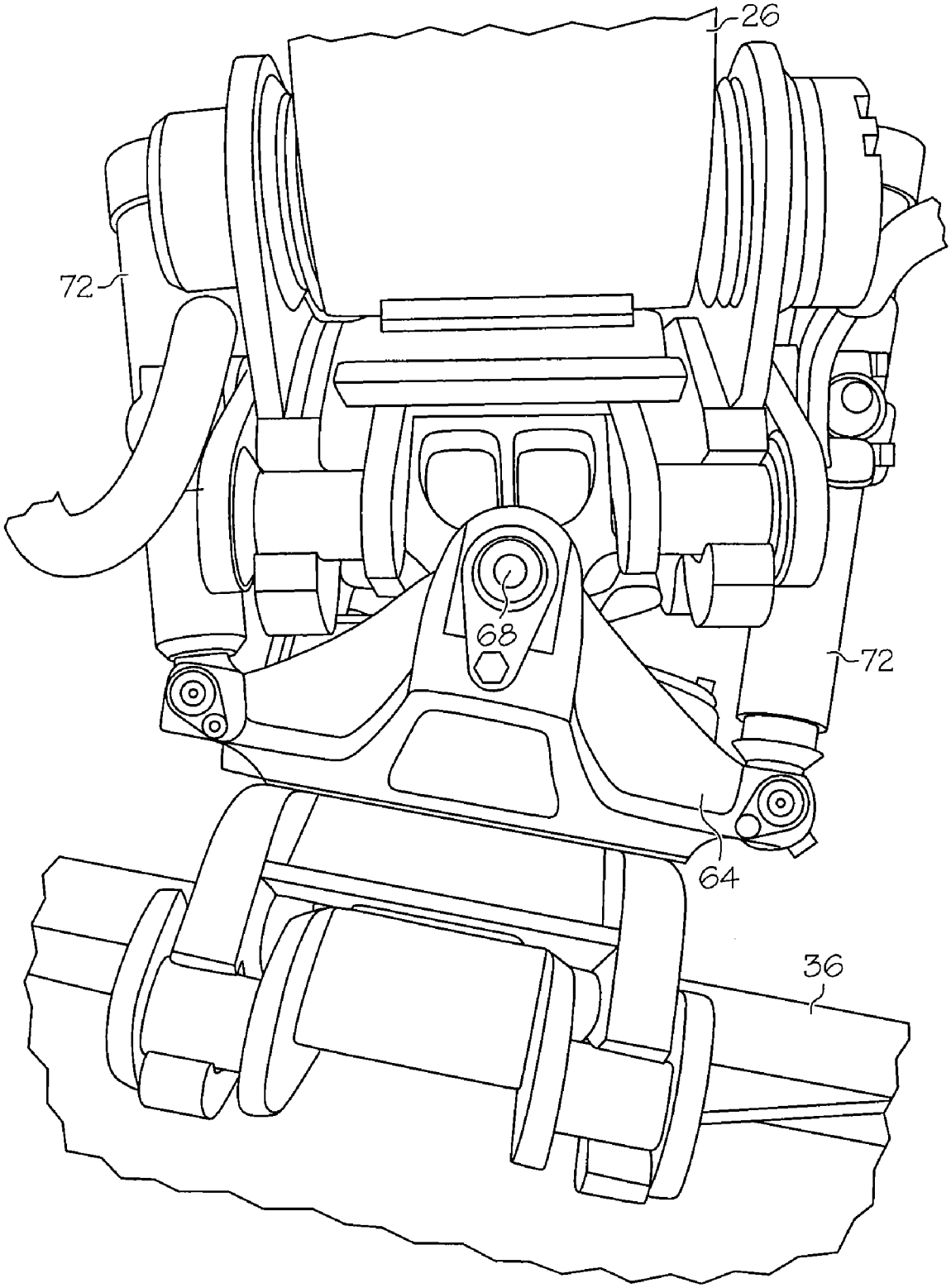
FIG. 5 is a further enlarged view of the dipper stick, the bucket and the coupling, similar to FIG. 4, showing the coupling tipped.

Let '$L_{PG}$' be the vertical distance between the points P and G and let '$\delta_1$' be the angle between the line passing through the points G and H and the tilting axis of the bucket (refer FIG. 4).

Position of S with respect to G is given by:

$$(S_x, S_y, S_z) = \{0, -(L_{RG}1 + L_{PG}1), -L_{PG}\} \quad [11]$$

If $\theta_{BP}$ is the pitch of the bucket then the slope of GH is given by: $(\theta_{BP}+\delta_1)$. Rotating the vector $\overrightarrow{GS}$ about G by '$(\theta_{BP}+\delta_1)$' gives the position of S with respect to G:

$$(S'_x, S'_y, S'_z) = \{0, -S_z \sin(\theta_{BP}+\delta_1), S_z \cos(\theta_{BP}+\delta_1)\} \quad [12]$$

From [8] and [12] position of J with respect to G is given by:

$$J_X = J'''_x + S'_x = J'''_x (\because S'x = 0)$$

$$J_Y = J'''_y + S'_y$$

$$J_Z = J'''_z + S'_z \quad [13]$$

Adding the position given in [13] to the position of G with respect to the center of rotation of the machine, we get the position of J with respect to the center of rotation of the machine.

While certain representative embodiments and details have been shown for purposes of illustrating the invention, it will be apparent to those skilled in the art that various changes in the invention disclosed herein may be made without departing from the scope of the invention, which is defined in the appended claims.

What is claimed is:

1. A control system for a tool coupling of the type used to attach a tool to an excavator having a boom pivotally attached to a dipper stick, said boom and said dipper stick defining a common plane, the tool coupling being attached to the end of the dipper stick and the tool coupling providing for rotation of the tool with respect to the dipper stick about a rotation axis that is generally in said common plane of said boom and dipper stick, and for tilting of the tool about an axis that is generally perpendicular to the rotation axis, comprising:

a rotation sensor on said coupling for determining the amount of rotation of the tool about said rotation axis with respect to the dipper stick, a tilt sensor on said coupling for determining the amount of tilt of the tool with respect to gravity, and a control, responsive to said rotation sensor and to said tilt sensor, for determining the orientation of the tool.

2. The control system of claim 1 in which said tilt sensor determines the amount of tilt of the tool with respect to gravity about two orthogonal axes.

3. The control system of claim 1 in which said control provides an output indicating the rotation of the tool about the rotation axis with respect to the dipper stick and the tilting of the tool with respect to a gravity reference.

4. The control system of claim 3 in which the tool is an excavator bucket having teeth and the control provides an output indicating the rotation of the bucket with respect to the dipper stick and the tilting of the teeth of the bucket with respect to gravity.

5. The control system of claim 4 further comprising a display, and in which the output of the control is provided to a display to assist an operator in controlling the position of the excavator bucket.

6. The control system of claim 4 in which the output of the control is provided to a position control system for controlling the orientation and position of the bucket to effect excavation automatically in a desired manner.

7. A control system for an excavator of the type having a boom extending from the excavator frame, a dipper stick pivotally attached to the boom and extending therefrom, said boom and said dipper stick defining a common plane, a bucket having bucket teeth, and a coupling attaching the bucket to the excavator dipper stick and providing for rotation of the tool about a rotation axis that is generally in said common plane of said boom and dipper stick and generally parallel to said dipper stick, and tilting of the tool about an axis that is generally perpendicular to the rotation axis, comprising:

a rotation sensor on said coupling for determining the amount of rotation of the bucket about said rotation axis with respect to the dipper stick, and a tilt sensor on said coupling for determining the amount of tilt of the bucket with respect to gravity, a control, responsive to said rotation sensor and to said tilt sensor, and further responsive to a positioning system on said excavator, for determining the position and orientation of the teeth of the bucket and for controlling movement of the teeth of the bucket to excavate in a desired manner.

8. The control system of claim 7 in which said in which said tilt sensor determines the tilt of the bucket with respect to a gravity reference in two orthogonal axes.

9. The control system of claim 7 in which said control provides an output indicating the rotation of the bucket about the rotation axis with respect to the dipper stick and the tilting of the bucket with respect to a gravity reference.

10. The control system of claim 7 in which the output of the control is provided to a display for viewing by the operator of the excavator.

11. An excavator, comprising:

an excavator frame, a boom extending from the excavator frame, a dipper stick pivotally attached to the boom and extending therefrom, said boom and said dipper stick defining a common plane, a bucket having bucket teeth, a coupling attaching the bucket to the excavator dipper stick and providing for rotation of the tool with respect to the dipper stick about a rotation axis that is generally in said common plane of said boom and dipper stick and generally parallel to said dipper stick, and for tilting of the bucket about a tilt axis that is generally perpendicular to said rotation axis, a positioning system on said excavator for determining the location of said coupling, a rotation sensor on said coupling for determining the amount of rotation of the bucket about said rotation axis, a tilt sensor on said coupling for determining the amount of tilt of the bucket with respect to gravity, and a control, responsive to said rotation sensor and to said tilt sensor, and further responsive to a positioning system on said excavator, for determining the position and orientation of the teeth of the bucket and for controlling movement of the teeth of the bucket to excavate at the work site in a desired manner.

12. The excavator of claim 11 in which said tilt sensor determines the tilt of the bucket with respect to a gravity reference in two orthogonal axes.

13. The excavator of claim 12 in which said control provides an output indicating the rotation of the bucket with respect to the dipper stick and the tilting of the bucket with respect to a gravity reference.

14. The excavator of claim 12 in which the output of the control is provided to a display for viewing by the operator of the excavator.

15. A control system for an earth working machine of the type having a boom, and a dipper stick pivotally attached to said boom and extending therefrom, said boom and said dipper stick defining a common plane, a tool having a working portion, and a coupling attaching the tool to the dipper stick and providing for rotation of the tool with respect to the dipper stick about a rotation axis that is generally in said common plane of said boom and dipper stick, and for tilting of the tool about an axis that is generally perpendicular to the rotation axis, comprising:

a rotation sensor on the coupling for determining the amount of rotation of the tool about said rotation axis, a tilt sensor on the coupling for determining the amount of tilt of the tool with respect to gravity, and a control, responsive to the rotation sensor and to the tilt sensor, and further responsive to a positioning system on the excavator, for determining the position and orientation of the working portion of the tool and for controlling movement of the working portion of the tool.

16. The control system of claim 15 in which the tilt sensor determines the tilt of the tool with respect to a gravity reference in two orthogonal axes.

17. The control system of claim 15 in which the control provides an output indicating the rotation of the tool with respect to the dipper stick and the tilting of the tool with respect to a gravity reference.

18. The control system of claim 15 in which the output of the control is provided to a display for viewing by the operator of the earth working machine.

* * * * *

UNITED STATES PATENT AND TRADEMARK OFFICE

CERTIFICATE OF CORRECTION

PATENT NO. : 7,810,260 B2
APPLICATION NO. : 11/962203
DATED : October 12, 2010
INVENTOR(S) : Richard M. Pope et al.

It is certified that error appears in the above-identified patent and that said Letters Patent is hereby corrected as shown below:

Col. 6, Line 63 "$J'_x = {}_x = 0$" should read -- $J'_x = J_x = 0$ --.

Signed and Sealed this
Twenty-sixth Day of April, 2011

David J. Kappos

David J. Kappos
*Director of the United States Patent and Trademark Office*